US005839955A

United States Patent [19]

Mangano et al.

[11] Patent Number: 5,839,955

[45] Date of Patent: Nov. 24, 1998

[54] SPINNING WHEEL GAME AND DEVICE THEREFORE

[76] Inventors: Barbara Mangano; Mark Casburn, both of 3100 E. Kingspoint, Las Vegas, Nev. 89120

[21] Appl. No.: 746,605

[22] Filed: Nov. 13, 1996

[51] Int. Cl.[6] ..... A63F 9/24

[52] U.S. Cl. ..... 463/16

[58] Field of Search ..... 463/16, 17, 18, 463/19, 20; 372/142 H, 142 HA, 142 R, 142 J, 142 JA, 292, 293, 294

[56] References Cited

U.S. PATENT DOCUMENTS

| | | | |
|---|---|---|---|
| 1,892,664 | 1/1933 | Eyles . | |
| 2,246,383 | 6/1941 | Rice . | |
| 2,565,557 | 8/1951 | Guimond . | |
| 3,941,389 | 3/1976 | Guimond . | |
| 4,492,378 | 1/1985 | Williams . | |
| 5,188,363 | 2/1993 | Marnell, II et al. . | |
| 5,496,038 | 3/1996 | Kangsanaraks | 273/292 |
| 5,607,162 | 3/1997 | Boylan et al. | 273/292 |

FOREIGN PATENT DOCUMENTS 5285252 of 0000 Japan .

*Primary Examiner*—George Manuel
*Attorney, Agent, or Firm*—Quirk & Tratos

[57] ABSTRACT

A device and method for playing a game are set forth which includes a display having five concentrically arranged wheels each having an indicia of an Ace, King, Queen, Jack, Ten and a wild symbol. The wheels are rotated to randomly present an indicia from each wheel at a payline as an outcome. Players wager on the outcomes which generally correspond to rules of poker. A layout provides for designated wagers of a royal, five of a kind, four of a kind, a full house, a straight which includes a wild symbol, three of a kind, two pair and one pair. Winning wagers are paid at odds corresponding to the probabilities of that outcome occurring and losing wagers are collected.

34 Claims, 6 Drawing Sheets

SPINNING WHEEL GAME AND DEVICE THEREFORE

FIELD OF THE INVENTION

The present invention relates to games and more particularly to games of chance and methods therefore.

BACKGROUND OF THE INVENTION

Games of chance are fun and exciting for players to play for amusement. The excitement is enhanced when the game is played in a casino setting whereat players can wager upon an anticipated outcome of the game. If the anticipated outcome occurs, the wager is won and the player receives a prize. If the outcome wagered upon does not occur, the wager is lost.

One such game found in many casinos is referred to as the Wheel of Fortune game. Typically, such Wheel of Fortune games are based upon the use of a large wheel or spinner which is rotated by an employee of the casino and gradually slows until it stops to register one of a plurality of spaces around its periphery at a payline. The peripheral spaces are marked, often with representations of denominations of money, to indicate the difference between the various outcomes which can be wagered upon. For example, different denominations of dollar bills, five dollar bills, ten dollar bills, twenty dollar bills and one or two joker or logo indicia are distributed about the periphery in different concentrations. A wagering board, having like symbols of the denominations, provides a place for the players to make wagers. Payoffs are determined by the concentrations of the symbols, e.g. dollar bills, in relation to the overall number of peripheral spaces. Thus, a player may place a wager on a dollar bill and twenty dollar bill anticipating that the Wheel of Fortune game will register when it stops at the payline a like dollar bill or twenty dollar bill. Payoffs may be, for example, 1 to 1 for a dollar bill symbol wager and 20 to 1 for a twenty dollar symbol wager.

The Wheel of Fortune game, while providing fun and excitement, has several drawbacks. One drawback is that typically the payoffs offered do not exceed 40 to 1. Therefore, large jackpots can not be awarded. The offering of a large jackpot contributes to the excitement of the game for players and bystanders alike.

Furthermore, the Wheel of Fortune game does not proactivley induce passersby or bystanders to play the game. Quite often, for this reason, the Wheel of Fortune game in casinos is often tucked away at a location near for example, a restaurant to garner casual play as passersby wager their pocket change. The simplicity of the game, the lack of proactive enticement of players and the failure to offer large jackpots has impacted the ability of the Wheel of Fortune game to compete with other games.

SUMMARY OF THE INVENTION

There is, therefore, provided according to the present invention, a game suitable for casino or non-casino play which offers a jackpot and which provides proactive enticement of players to increase excitement of the game and method provided herein.

Accordingly, the present invention is directed to a device for playing a game of chance using representations of selected playing cards. The device includes a display representing five concentric areas. In each of the concentric areas, there are representations of an Ace, King, Queen, Jack, Ten and a Wild symbol. The device includes means for randomly selecting a representation from each area to display as a combination outcome. For example, when initiated by a player or the attendant, the device would cause the random selection and display of a symbol from each of the areas constituting an outcome of Ace, Ace, King, Queen, Ace.

The designated outcomes are based upon the rules of poker.

In one embodiment, the display is mechanically derived including five concentrically arranged wheels each rotatably disposed on a pedestal for independent rotation. The indicia are imprinted at spaced locations about each of the wheels.

To play the game, the player makes at least one wager on an anticipated outcome selected from;

(i) Ace, King, Queen, Jack and Ten in sequence (Rainbow Royal);

(ii) five Wild symbols;

(iii) five of a kind;

(iv) four of a kind;

(v) a full-house;

(vi) a straight;

(vii) three of a kind;

(viii) two pair; and (ix) a pair.

After all wagers have been made, the rotation of the wheels is initiated. The wheels independently rotate and, by external forces such as friction or mechanical braking, slow to align an indicia from each wheel at a payline. The indicia aligned along the payline are the combination outcome upon which wagers are paid or lost.

In an electronically derived game, the display when initiated presents the appearance simulating the rotation of wheels for a period of time to ultimately align the outcome combination at a payline.

To proactively entice players, the payline can be illuminated in one or more colors and color sequences as can a wagering area designated to receive players wagers. When an outcome combination is selected, the corresponding wagering area is illuminated to identify to the players which combination has occurred. The illumination of the selected combination of the payline as well as the illumination at the wagering table increases the excitement of the game, is visible from distant locations and hence proactively entices players to participate in the game.

Still further, upon a selected outcome, e.g. straight, or better, means for playing music can be initiated. The combined effect of the lights and music entices players to play the game.

The method for playing the game includes providing a display representing concentric areas including at least one of each of the indicia of an Ace, King, Queen, Jack, Ten and a Wild symbol. Players play the game by wagering on one or more or the anticipated outcomes set forth above. The method also includes initiating the display to represent the random selection of an indicia from each of the concentric areas to ultimately display an outcome. If the player has wagered on the outcome, his or her wager is paid preferably at odds in relation to that outcome occurring in comparison to all possible outcomes. If the player has wagered upon an outcome that did not occur, the player's wager is collected. New wagers are thereafter placed in anticipation of the next "spin".

As can be appreciated, the game according to the present invention can provide for a large jackpot for certain outcome combinations. Furthermore, the use of the five concentric areas contributes to the excitement of the game as the players and bystanders watch the interplay of the areas as the indicia are selected. Furthermore, the feature of illuminated the payline and wagering area corresponding to the outcome and the play of music, further attracts players to play the game.

BRIEF DESCRIPTION OF THE DRAWINGS

These and other features and advantages will become appreciated as the same becomes better understood with reference to the specification claims and drawings wherein:

DESCRIPTION

Figure 1:
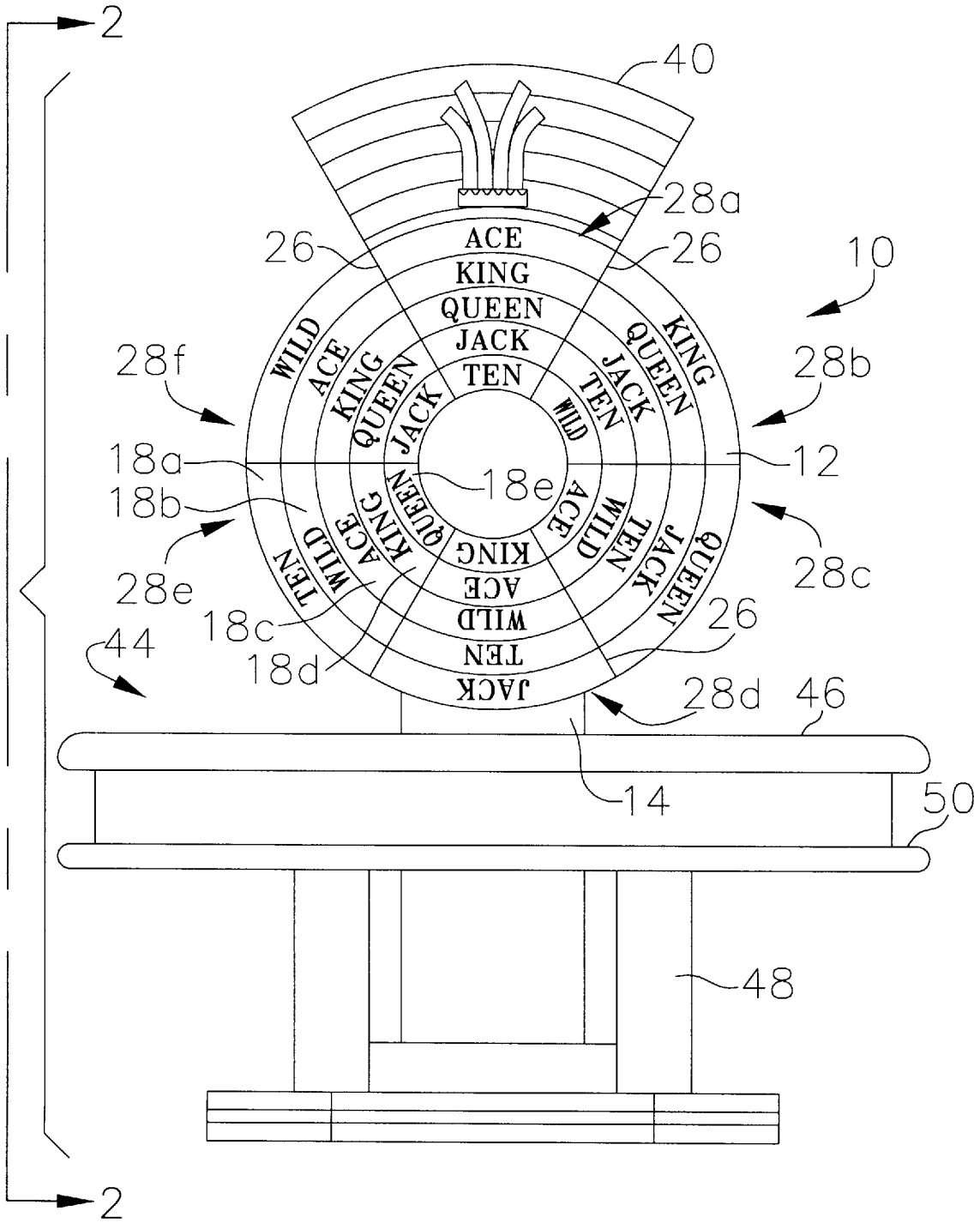
FIG. 1 is a front view of a device for playing the game according to the present invention.
Figure 2:
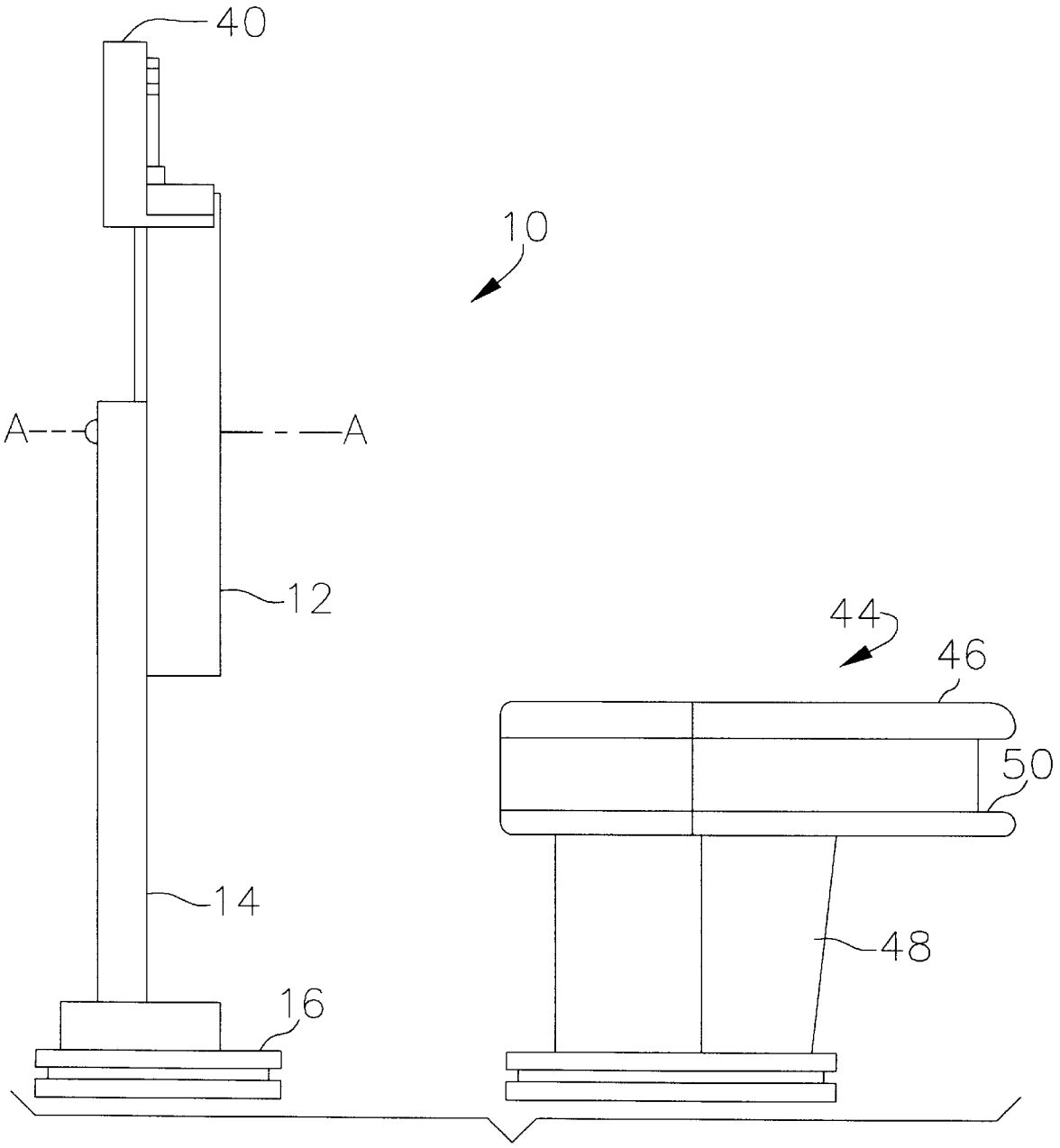
FIG. 2 is a side view of the device of FIG. 1
Figure 3:
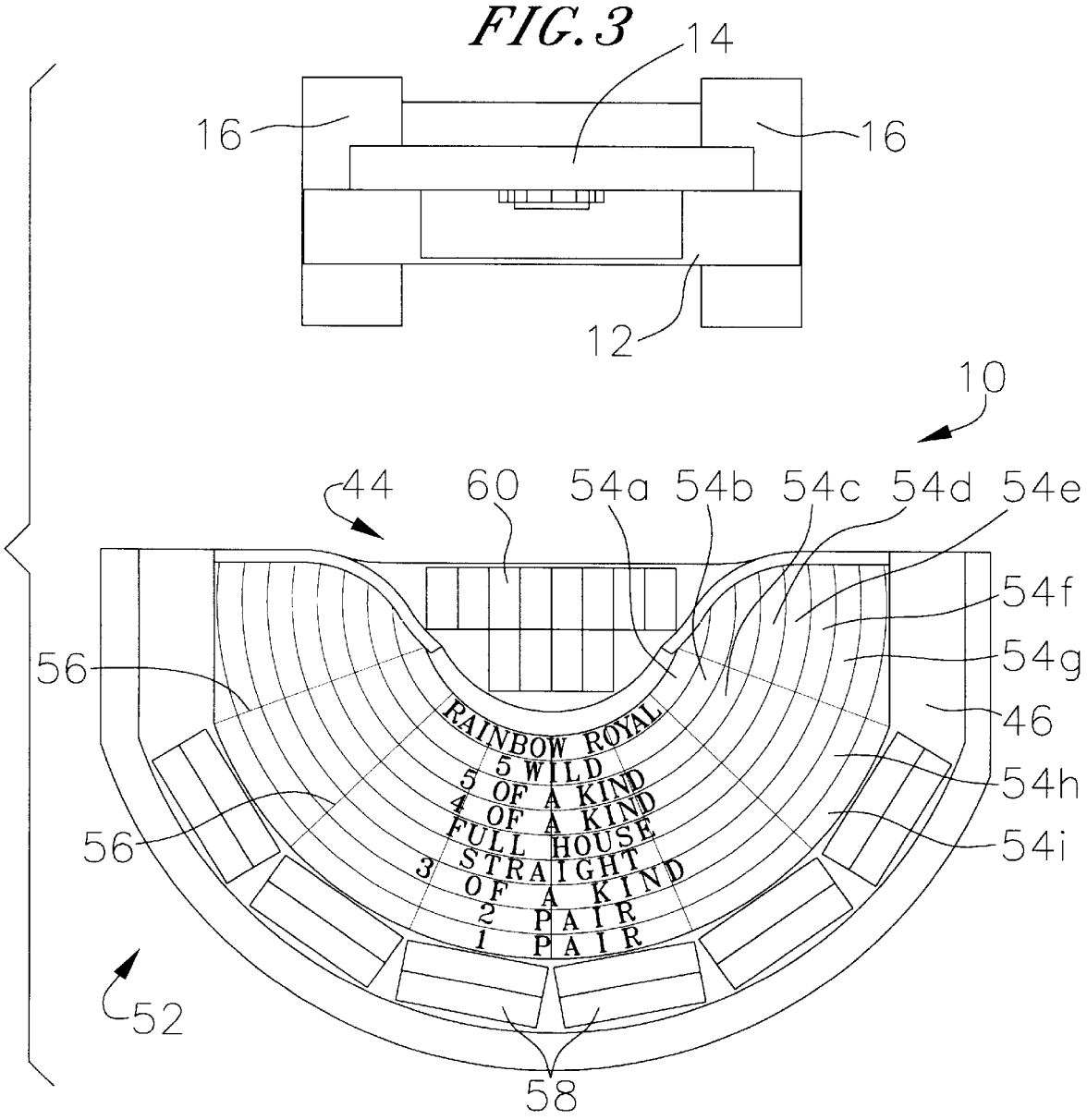
FIG. 3 is a top view of the device of FIG. 1 illustrating the wagering area.

Turning to the drawings, FIGS. 1 through 3 illustrate a mechanical embodiment of a device 10 according to the present invention. The device 10 includes a display 12 supported above the ground by a pedestal 14. As illustrated, the display 12 may be circular and have a diameter of 5 feet or more to be visible from a distance to entice players to approach and play the game using the device 10. To support the upstanding orientation of the pedestal 14 and display 12, the pedestal has a pair of spaced feet 16 which rest on the ground.

The display 12 has five concentrically disposed wheels 18*a–e* each disposed for independent rotation relative to the pedestal 14 about a common axis shown as axis A. For this purpose, each wheel 18*a–e* may be journaled to a common axle (not shown) or may be independently journaled as illustrated in FIG. 4.

Figure 4:
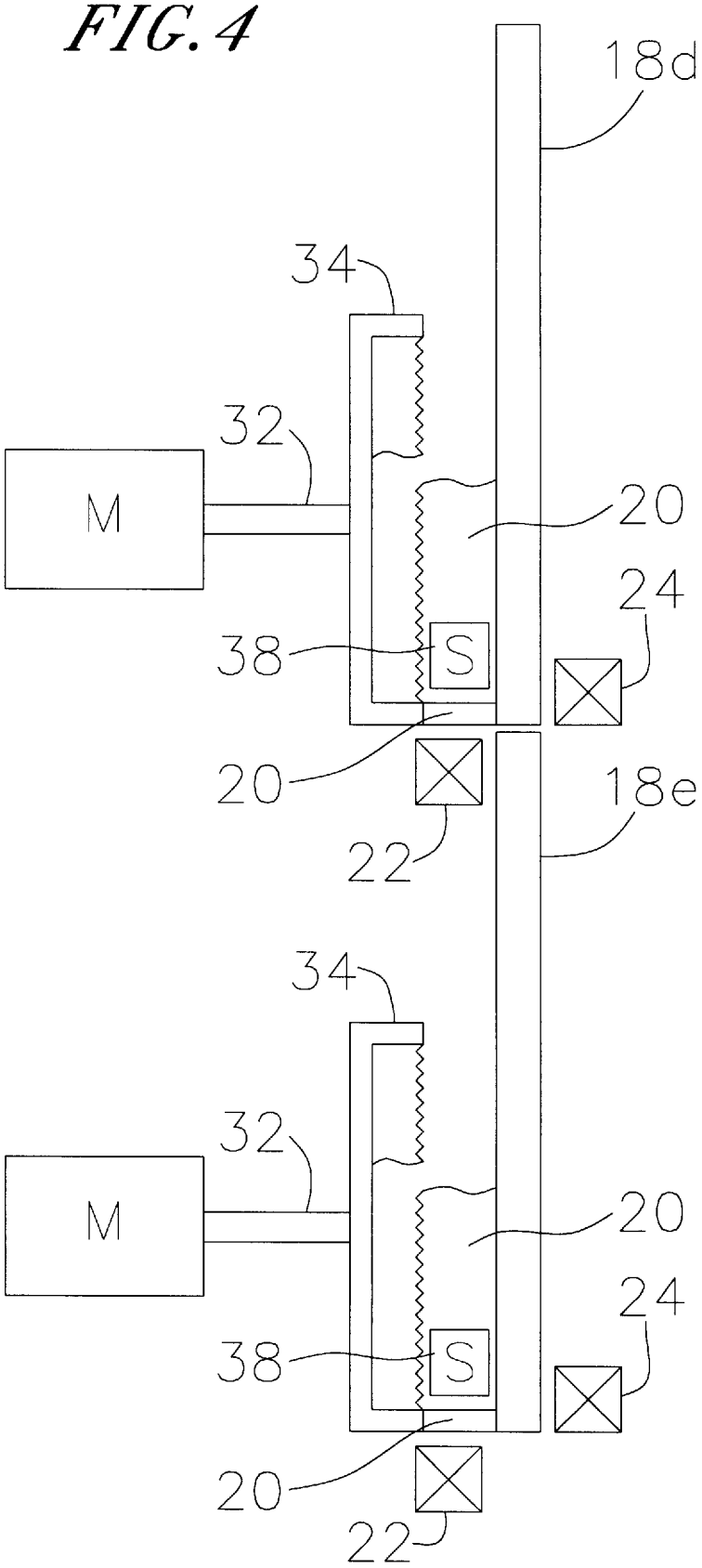
FIG. 4 is a partial section view of a portion of the device of FIG. 1 illustrating a means for randomly selecting indicia.

With reference to FIG. 4 a means for journaling the wheels 18*a–e* for independent rotation is illustrated with reference only to wheels 18*d,e*. Each wheel 18*d* and *e* includes a peripheral track 20 supported upon load bearings 22 which are, in turn, fixed to the pedestal 14. To maintain the planar, horizontal alignment of the wheels 18*a–e,* alignment bearings 24 are provided on spokes 26 (FIG. 1) which radiate from the axis A radially outward at the front of the display 12. Accordingly, each wheel 18*a–e* is journaled on the pedestal 14 for independent rotation relative thereto.

It is to be understood that other means could mount the wheels 18*a–e* for rotation relative to the pedestal 14 as by configuring the track to have an upstanding lip to contact alignment bearings 24 located behind the wheels 18*a–e*. It is also to be understood that other suitable means for journaling the wheels 18*a–e* to the pedestal 14 could be used.

Each wheel 18*a–e* is divided into six sectors 28*a–f*. The spokes 26, as illustrated in FIG. 1, may be arranged to delineate the sectors 28*a–f* of each of the wheels 18*a–e*. Alternatively, if the spokes 26 are dispensed with, the sectors 28*a–f* may be graphically represented on the wheels 18*a–e* as by radial lines. The delineation of the sectors 28*a–f* on the wheels 18*a–e* contributes to the symmetrical appearance of the display 12 and further, when the wheels 18*a–e* are rotated as hereinafter described, enhances the visual presentation of the rotation thereof.

Each of the wheels 18*a–e* carries at least six indicia preferable selected from playing cards. According to the preferred embodiment, each wheel 18*a–e* carries the following indicia: an Ace (A), King (K), Queen (Q), Jack (J), Ten (10) and a Wild symbol. As will hereinafter be described, the use of playing cards makes the presentation of the game familiar to players and further provides, as hereinafter described, for the application of commonly known rules of poker for the play of the game. To contribute to the symmetry of the display 12, each of the indicia is centered in a sector 28*a–f* of each of the wheels 18*a–e*.

The game, according to the presentation invention to be played with the device 10, is one in which combinations of indicia are randomly selected. According to the mechanically embodiment herein described of the device 10, the selecting means includes means for initiating the rotation of the wheels 18*a–e* to circulate the indicia about the display 12, the wheels 18*a–e* slowing to ultimately register indicia from each wheel 18*a–e* at a designated payline as an outcome combination. While the aforesaid rotation of the wheels 18*a–e* may be manually initiated by an attendant, preferable, the wheels are driven by suitable mechanical means such as hydraulic, pneumatic or as illustrated in FIG. 4, electric motors 30.

With reference to FIG. 4, rotation of each of the wheels 18*a–e* is initiated by closure of an initiator switch by a player or the attendant pressing a button which causes a processor (not shown in FIG. 4) to energize the motors 30 associated with each wheel 18*a–e*. Each motor 30 has a shaft 32 mounting a gear 34 which in turn meshes with a ring gear provided on the perimeter of track 20. Accordingly, when energized, the motors 30 initiate the rotation of each of the wheels 18*a–e* to rotate each to a predetermined or randomly selected speed. RPM sensors (not shown) provide feedback to the processor to determine the speed of the rotation of each wheel 18*a–e*. When the wheels 18*a–e* have reached their designated speed, the motors 30 are de-energized and the wheels 18*a–e* freely rotate to slow and stop registering the indicia thereon at a designated payline shown in FIG. 1 as payline 36. As stated above, the wheels 18*a–e* under the control of the processor can be brought up to random speeds and can further be randomly rotated in different directions. Still further, the wheels 18*a–e* can be serially initiated to begin the rotation of each of the wheels 18*a–e* on a time sequence to contribute to the visual presentation of the display 12. The rotation of the wheels 18*a–e* provides for the random location of indicia at the payline 36 for the play of the game as hereinafter described.

To further enhance the visual presentation of the display, means are provided to align the wheel sectors 28*a–e* to align the indicia at the payline 36 when the outcome combination has been determined. For this purpose, means are provided to sense the position of each of the wheels 18*a–e*, these means embodied as optical or electrical sensors shown in FIG. 4 as sensors 38. During rotation of the wheel 18*a–e*, the sensors 38 sense the position of each wheel 18*a–e* and generate signals to a processor corresponding to those positions. The RPM sensor or, in the alternative the signal stream from the wheel sensors 38, sense the positions of the wheels 18*a–e* when the wheels 18*a–e* stop and based thereon energize the motors 30 to move the wheels 18*a–e* either clockwise or counterclockwise to align the presentation of outcome combination at the payline 36 as shown in FIG. 1. It is to be understood that other means could be used to accomplish the final alignment. The alignment of the indicia randomly selected by the rotations of the wheels 18*a–e* at the payline 36 enhances the visual appearance of the display 12.

To designate the payline 36, the device 10 includes in ornamental header 40 which can have any suitable and pleasing design. As illustrated in FIG. 1, the header 40 may be fan shaped having radial edges to align with the wheel sectors as finally aligned with the payline. Further, the header 40 may be provided with ornamental illumination to not only clearly designate the payline 36 but to attract players to play the game.

To further contribute to the appearance of the display 12, each of the wheels 18*a–e* may be fashioned to have a transparent or semi-transparent face 42 presenting a variety of colors for each of the wheels 18*a–e* on the display 12. For this purpose, each of the faces 42 may be of a different color and backlit with lighting. Alternatively, the faces 42 may be clear with colored backlighting to produce the same effect. As can be appreciated, by providing for different colors of wheels, the colors can cascade in a spectrum simulating a rainbow. Furthermore the processor when the wheels 18*a–e* are initiated for rotation, can sequence the lighting to cascade radially inwardly or outwardly or to, for example, cascade radially at the payline 36. The lighting of the wheels 18*a–e* can be combined with lighting of the header 40 to create an attractive and exciting presentation.

Preferably, the sectors 28*a* containing the following indicia for the following wheels 18*a–e* have the following colors to simulate a rainbow and represent the outcome of a "Rainbow Royal":

| Wheel | Indicia | Color |
|---|---|---|
| 18a | Ace | Red |
| 18b | King | Orange |
| 18c | Queen | Yellow |
| 18d | Jack | Green |
| 18e | Ten | Blue |

The remainder of the sectors 28*b–f* are white or of another color. Thus when the Rainbow Royal combination aligns, the sectors 28*a* of each wheel 18*a–e* present a striking visual cascade of colors at the payline simulating the colors of a rainbow.

Turning to FIG. 3, the device 10 also includes a wagering layout embodied as a table 44 having a top 46 supported on a suitable stand 48. A ledge 50 may be provided below the top 46 for players of the game to place drinks. The top 46 has a layout 52 designating the various wagers which a player can make during play of the game. The top 46 and layout 52 may be arcuate presenting nine wagering locations or bands 54*a–i*. These wagering bands carry identification to indicate the wager being made when a wager is placed in a designated band or bands 54*a–i*. For this purpose, the bands 54*a–i*, and for play of the game herein, would bear the designations:

54*a*. Rainbow Royal(a designated sequential AKQJ10 combination)

54*b*. Five wild symbols

54*c*. Five of a kind

54*d*. Four of a kind

54*e*. Full house

54*f*. Straight

54*g*. Three of a kind

54*h*. Two pair

54*i*. One pair

Thus, a player making a wager on band 54*c* designated as three of a kind, would be wagering that the randomly selected outcome combination of indicia would be a combination having three like indicia. The designations conform generally to the rules of poker. The straight designation corresponds to any straight combination (excluding the Rainbow Royal) and any straight combination using including only one Wild symbol. For example combinations of K,Q,J,10,A or Q,J,10,Wild,K would both be straights. An outcome of A,K,Wild,Wild,10 would be a pair of Wilds combination.

At the top 46, various player locations are demarcated as by lines 56 to correspond to the player locations. Where the top 46 is arcuate, the lines 56 divide the top into sectors. With continuing reference to FIG. 3, at the base of each sector, when viewing the top 46 from above, there is located a check tray 58 in which players place chips or checks for play of the game. Opposite the check trays 58 is a bank 60 where the game attendant retains chips or checks paid and received during play of the game.

To identify which outcome combination has occurred, means are provided for generating a marker in the band 54*a–i* which corresponds to the outcome. This marker generating means may be by use of a puck or similar marker by the attendant or by projecting a spot in the appropriate band 54*a–i*. Preferably, the layout 52 is transparent or semi-transparent such as being fashioned from glass or acrylic and means are provided beneath the layout 52 for lighting the band 54*a–i* corresponding the outcome combination. As with the wheels 18*a–e*, each of the bands 54*a–i* may be colored to provide a cascade of colors visually pleasing to the players or, in the alternative, the lighting below the layout 52 may include color lights to accomplish the same end. Preferably, the bands 54*a–i* are each a selected different color to somewhat correspond to the cascading color spectrum of a rainbow.

The illumination of the corresponding band 54*a–i* may be initiated by the attendant or may be automatically controlled by the game processor. In the automated embodiment, the sensors 38 identify the position of the wheels 18*a–e* and issue signals to the processor. The processor is preprogrammed to determine, based upon the signals from the sensors 38, the outcome combination. The controller in response thereto illuminates the corresponding band 54*a–i*.

To further enhance the visual presentation of the device 10, the bands 54*a–i* may flash through color sequences during the rotation of the wheels 18*a–e* prior to the display of the outcome.

The method for play of the game, according to the present invention, is for one or more players to make one or more wagers at a desired band 54*a–i*, that wager meaning that the player believes that the wagered upon combination or combinations will be selected. After all wagers have been made by players in their designated areas, the rotation of the wheels 18*a–e* is initiated. The initiation may be by the attendant or a player. The motors 30 drive the wheels 18*a–e* to rotate and thereafter are de-energized. The wheels 18*e–f* due to friction slow and register randomly selected indicia from each wheel 18*a–e* at the payline 36 as the outcome. As stated above, the wheels 18*a–e* are aligned when the outcome is selected. If the outcome corresponds to the wager made by the player, the player is paid at odds corresponding to the probabilities of that outcome. If the wagered upon outcome does not occur, the player's wager is collected.

The payoffs for winning wagers for each of the outcome can be as follows:

| Outcome | Payoff |
|---|---|
| Rainbow Royal | 7000 to 1 |
| 5 Wild symbols | 5000 to 1 |
| 5 of a kind | 1,400 to 1 |
| 4 of a kind | 48 to 1 |
| Full house | 24 to 1 |
| Straight | 10 to 1 |
| 3 of a kind | 6 to 1 |
| 2 pair | 4 to 1 |
| 1 pair | 2 to 1 |

To further enhance the excitement of the game, a progressive jackpot may be offered for the Rainbow Royal and five wild symbol combinations. This progressive jackpot may be funded from a portion of the wagers made by players during play of the game. A progressive meter (not shown) associated with the header 40 would display the current amount of the progressive jackpot.

Figure 5:
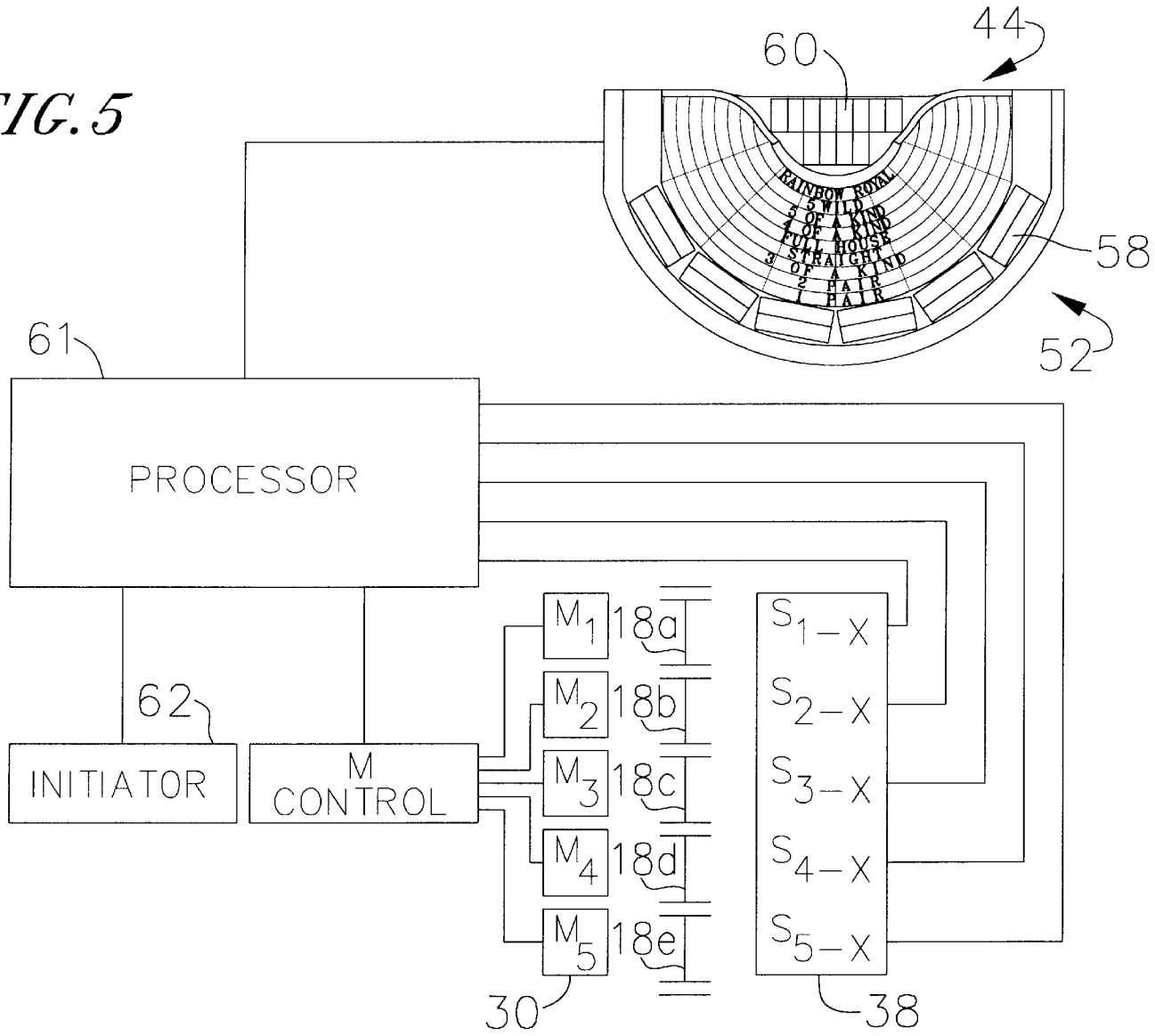
FIG. 5 is a schematic relating to the mechanical embodiment of the device according to the present invention.

With reference to FIG. 5, a further embodiment of the present invention is shown. According to this embodiment, the selection of the indicia combination is controlled by a processor 61 which randomly selects them all possible combinations. As illustrated, when the game is initiated at an initiator 62 such as the dealer or a player depressing a button, the processor 61 makes the random selection of the outcome and thereafter controls the motors 30 ($M_1$–$M_5$) to rotate the wheels 18*a–e* in an apparent random fashion for the players to see. The sensors 38 ($S_{1-x}$–$S_{5-x}$) sense the position of the wheels 18*a–e* and provide feedback to the processor 61. Based upon a controlled sequence, the wheels 18*a–e* are slowed to register the randomly selected outcome at the payline 36. As also illustrated in FIG. 5, when the selection of the outcome has registered with the payline 36, the processor 61 controls the layout 56 to illuminate the corresponding wagering band 54*a–i* in a manner described above. The use of the processor 61 to randomly select indicia combinations dispenses with any mechanical bias which may occur where the wheels 18*a–e* rotated to randomly present the indicia at the payline 36.

As a further embodiment, the display 12 may be in the form of a projection. Appropriate lighting behind transparent or semi-transparent fixed wheel faces 42 would be adapted to simulate rotation of wheels or to momentarily flash the indicia about the perimeter of each simulated wheel 18*a–e* of the display 12. A processor would randomly select the indicia combination and would thereafter enter a sequence to flash indicia or simulate rotation of wheels to ultimately align the randomly selected indicia combination at the payline 36. The projected display embodiment dispenses with the mechanical requirements of motors, wheel drives bearings and other supports.

Figure 6:
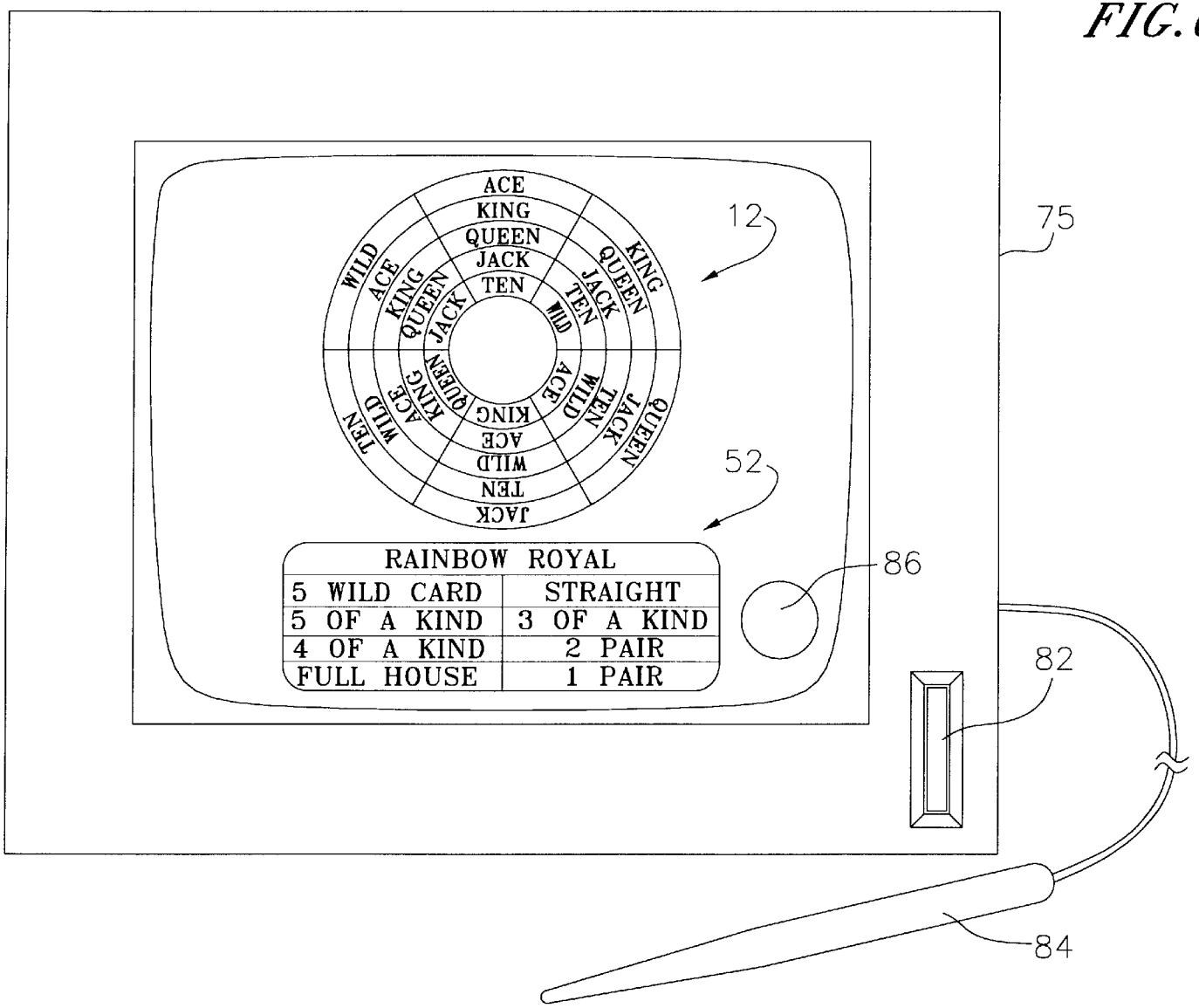
FIG. 6 illustrates a video embodiment of the game and method according to the present invention.

With reference to FIG. 6, still a further embodiment of the present invention. According to this embodiment, the display 12 is projected on a video display 75 along with the layout 52. According to this version, players would input wagers as by coins in a coin slot 82, currency or credits and would make selections of anticipated outcomes as by marking on the layout with a light pen 84 or the like. For example, a player may wager five coins on a full-house and three coins on a five of a kind. Thereafter the player would initiate a play button 86 at which time a processor would randomly select an outcome from all possible outcomes, simulate rotation of the wheels on the display and ultimately present this selected outcome. If the player wins the wager, the machine pays the player as by accumulating credits or by dispensing coins. If the wager is lost, the machine retains the wager.

To further enhance the presentation of the game, a speaker (not shown) may be provided to issue music when predetermined outcomes occur. For example for an outcome of a straight or better the processor 61 would initiate a tape player or access music digitally stored to play music at the speaker. Still further a library of songs can be stored which are randomly selected and played when the predetermined event has occurred.

As yet another variation, the motors 30 can drive rollers which frictionally engage the wheels 18*a–e* or the tracks thereof to rotate the wheels 18*a–e* in the manner described above.

As can be appreciated, the device 10 and game play method according to the present invention provides an exciting game for players to play. The rotating wheels or simulated rotation of wheels or indicia generate excitement as players anticipate that the outcome will match their wagers. The lighting of the wheels, header and layout further contributes to the excitement. As a further advantage the automated lighting of the outcome on the layout assists the attendant and players during play of the game.

As still a further version, the indicia would be placed on five cubic dice, each die having on each of its six side areas one of the following indicia; Ace, King, Queen, Jack, Ten and a Wild symbol. Furthermore the Rainbow Royal would be represented by putting a background behind or otherwise highlighting a selected Ace, King, Queen and Ten of eack of five dice. For exambple die one would have the Ace highlighted in red, die two would have the King highlighted in orange, die three the Queen in yellow, die four the Jack in green and die five the Ten in Blue.

To play the game using die, wagers are made in the manner described above. A selected player or the dealer would the cast the five die and the display of the top facing indicia would be the outcome. Wagers would be resolved in the manner described above based upon the outcome While we have shown and described certain embodiments to the present invention, it is to be understood that it is subject to many modifications and changes without departing from the spirit and scope of the claims presented herein.

We claim:

1. A device for playing a game of chance using representations of selected playing cards comprising:

a display representing five areas;

means in each area for representing spaced indicia of an Ace, King, Queen, Jack, Ten and a wild symbol;

means for randomly selecting an indicia from each area to display as a combination outcome; and means for a player of the device to place a wager upon at least one anticipated outcome, said wagers representing anticipated winning outcomes of, (i) a selected Ace, King, Queen, Jack, and Ten combination, (ii) five wild symbols, (iii) five of a kind, (iii) four of a kind, (iv) a full house, (v) a straight, (vi) three of a kind, (vii) two pair, and (viii) a pair.

2. The device of claim 1 wherein said device has five concentric areas and includes a designated payline, said random selecting means and display means cooperation to display said outcome at said payline.

3. The device of claim 2 further including means for illuminating radially aligned sectors of said areas at said payline.

4. The device of claim 2 wherein said display areas are divided into six sectors and said representing means includes intermittently representing each indicia in each sector proceeding the display of the outcome.

5. The device of claim 1 further including means for paying the player if the outcome is the wagered upon combination.

6. The device of claim 5 including a progressive jackpot, the paying means including paying the player approximately according to a pay schedule of,

| | |
|---|---|
| Selected Ace, King, Queen, Jack, Ten Combination | Progressive Jackpot |
| Five wild symbols | Progressive Jackpot |
| Five of a kind | 1400 to 1 |
| Four of a kind | 48 to 1 |
| Full house | 24 to 1 |
| Straight including a wild symbol | 10 to 1 |
| Three of a kind | 6 to 1 |
| Two pair | 2 to 1. |

7. The device of claim 1 wherein the display includes five concentrically disposed rotatable wheels having said indicia thereon and said random selecting means includes means for initiating rotation of each of the wheels to randomly stop and register said outcome at said payline.

8. The device of claim 7 wherein each wheel has one of each indicia spaced about the wheel.

9. The device of claim 8 further including means for radially aligning the outcome indicia.

10. The device of claim 9 further including means for illuminating the outcome at the payline.

11. The device of claim 10 wherein the illuminating means is adapted to illuminate radially aligned sectors of each wheel at the payline.

12. The device of claim 10 including a sensor to determine the indicia of the outcome and produce signals responsive thereto, a processor to process said signals to determine which outcome has been obtained, said processor controlling said indicating means to produce an indicator at the corresponding wagering location.

13. The device of claim 1 including a wagering location at which the player indicates their wager.

14. The device of claim 13 including means for indicating the outcome at the corresponding wagering location.

15. The device of claim 14 wherein said indicating means includes means for lighting the corresponding wagering location.

16. The device of claim 15 including a sensor to determine the indicia of the outcome and produce signals responsive thereto, a processor to process said signals to determine which outcome has been obtained, said processor controlling said lighting means to light the corresponding wagering location.

17. A device for playing a game of poker using representations of selected playing cards comprising:

a display of five circular, concentrically arranged areas, each of said areas including six sectors;

means for displaying in the sectors indicia of an Ace, King, Queen, Jack, Ten and a wild symbol;

means for randomly selecting an indicia from each area as an outcome combination, means for presenting the selected outcome on the display; and a wagering layout at which a player may indicate a wager on an outcome of, (i) a selected Ace, King, Queen, Jack, and Ten combination, (ii) five wild symbols, (iii) five of a kind, (iii) four of a kind, (iv) a full house, (v) a straight, (vi) three of a kind, (vii) two pair, and (viii) a pair.

18. The device of claim 17 wherein the random selecting means includes a processor adapted to randomly select from all possible combinations said outcome.

19. The device of claim 18 further including a payline, said selected outcome presented at said payline.

20. The device of claim 19 wherein said processor is adapted to intermittently present indicia about the display proceeding presentation of said combination.

21. The device of claim 20 further including means for radially aligning the outcome indicia.

22. The device of claim 21 including illuminating each wheel in a different color.

23. The device of claim 22 wherein each wheel is divided into six sectors each having a different indicia displayed thereon.

24. The device of claim 23 wherein the wagering layout includes an illuminable location for each wager, the device further including a sensor to determine the indicia of the outcome and produce signals responsive thereto, a processor to process said signals to determine which outcome has been obtained, said processor controlling lighting means to illuminate the corresponding wagering location.

25. The device of claim 19 wherein each wheel has only one of each indicia spaced about the wheel.

26. The device of claim 25 wherein the illuminating means is adapted to illuminate radially aligned sectors of each wheel at the payline.

27. The device of claim 17 wherein the display includes five concentrically disposed rotatable wheels having said indicia thereon and said random selecting means includes means for rotating each of the wheels to randomly stop and register said outcome at a payline.

28. The device of claim 27 further including means for illuminating the outcome at the payline.

29. The device of claim 27 wherein the random selecting means includes a processor adapted to randomly select said outcome from all possible combinations of indicia, said processor controlling the rotating means to rotate and stop the wheels to present the selected outcome combination at the payline.

30. The device of claim 29 including means for radially aligning the wheel sectors of the outcome combination at said payline.

31. A device for playing a game of poker using representations of selected playing cards comprising:

a display having five concentrically arranged rotatable wheels each having spaced there around indicia of an Ace, King, Queen, Jack, Ten and a wild symbol;

a payline at the display;

means for rotating each wheel to randomly register an indicia of each wheel with the payline to present an outcome;

a wagering layout at which a player may indicate a wager on an anticipated outcome of, (i) a selected Ace, King, Queen, Jack, and Ten combination, (ii) five wild symbols,
(iii) five of a kind,
(iii) four of a kind,
(iv) a full house,
(v) a straight,
(vi) three of a kind,
(vii) two pair, and
(viii) a pair.

32. The device of claim 31 further means for illuminating the sectors at said payline.

33. A method for playing a game using selected playing cards comprising:

providing a display having five concentric areas, each area having an indicia of an Ace, King, Queen, Jack, Ten and a wild symbol;

a player wagering on an outcome resulting from the random selection of an indicia from each area;

randomly selecting an indicia from each area as an outcome;

comparing the outcome to the player's wagered outcome; and paying the player for winning wagers where the wagered outcome and the selected outcome correspond and collecting all other wagers.

34. A method for playing a game using representations of selected playing cards comprising;

providing a display having five concentric wheels each having thereon an indicia of an Ace, King, Queen, Jack, Ten and a wild symbol;

a player wagering on an outcome of,
(i) a selected Ace, King, Queen, Jack, and Ten combination,
(ii) five wild symbols,
(iii) five of a kind,
(iii) four of a kind,
(iv) a full house,
(v) a straight,
(vi) three of a kind,
(vii) two pair, and
(viii) a pair;

rotating the wheels to randomly position an indica from each at a designated payline;

comparing the outcome to the player's wagered outcome; and paying the player for winning wagers where the wagered outcome and the selected outcome correspond and collecting all other wagers.

* * * * *